US007310917B2

(12) United States Patent
Valdez

(10) Patent No.: US 7,310,917 B2
(45) Date of Patent: Dec. 25, 2007

(54) HINGED FRAME SPREADER

(76) Inventor: Andrew Valdez, 918 Claire Ct., Ocean Shores, WA (US) 98569

( * ) Notice: Subject to any disclaimer, the term of this patent is extended or adjusted under 35 U.S.C. 154(b) by 0 days.

(21) Appl. No.: 10/772,552

(22) Filed: Feb. 5, 2004

(65) Prior Publication Data

US 2005/0183374 A1 Aug. 25, 2005

(51) Int. Cl.
*E04G 21/00* (2006.01)

(52) U.S. Cl. ..... 52/127.8; 52/64; 52/71; 52/127.2; 52/127.5; 52/127.6; 52/127.7; 33/404; 33/194; 33/667; 254/39; 248/351; 248/354.1

(58) Field of Classification Search ..... 52/211–217, 52/127.2–127.4, 204.1, 204.5, 656.4, 68–72, 52/127.5, 127.6, 127.7, 127.8; 33/194, 197, 33/404, 562, 667, 749.1; 248/354.1, 354.3, 248/351, 354.5; 49/504; 254/39, 133 A
See application file for complete search history.

(56) References Cited

U.S. PATENT DOCUMENTS 503,536 A * 8/1893 Hales ..... 254/39
565,978 A * 8/1896 Haas ..... 254/39
837,595 A * 12/1906 Storr ..... 254/39
2,375,941 A * 5/1945 Nostrand ..... 5/512
3,171,627 A * 3/1965 Tapley et al. ..... 248/354.3
3,355,136 A * 11/1967 Staples ..... 248/352
3,420,193 A * 1/1969 Austgen ..... 105/422
3,612,463 A * 10/1971 Grant ..... 410/95
3,627,370 A * 12/1971 Whiteman et al. ..... 294/81.21
3,836,174 A * 9/1974 Holman, Jr. ..... 410/149
3,847,343 A * 11/1974 LaBate ..... 249/202
3,851,868 A * 12/1974 Lagasse ..... 269/8
3,892,378 A * 7/1975 Lane ..... 348/71
4,256,230 A * 3/1981 Clark et al. ..... 212/344
4,395,065 A * 7/1983 Nelson et al. ..... 292/339
4,438,640 A * 3/1984 Willis ..... 70/94
5,139,233 A * 8/1992 Goss ..... 254/134
5,522,685 A * 6/1996 Lessard ..... 410/121
5,662,429 A * 9/1997 Battocchio ..... 403/377
5,816,309 A * 10/1998 Paradise ..... 160/206
5,853,163 A * 12/1998 Chagnot ..... 254/100
5,957,310 A * 9/1999 Mitchell ..... 211/186
6,050,035 A * 4/2000 Thompson et al. ..... 52/167.1
6,152,424 A * 11/2000 Lapat ..... 254/98
6,247,274 B1 * 6/2001 Thompson et al. ..... 52/167.1
6,296,038 B1 * 10/2001 Chen ..... 160/199
6,371,422 B1 * 4/2002 St. Martin et al. ..... 248/200.1
6,421,965 B2 * 7/2002 Thompson et al. ..... 52/167.1
6,530,186 B2 * 3/2003 Torstensen ..... 52/217
RE38,075 E * 4/2003 Thompson et al. ..... 52/167.1
6,601,675 B2 * 8/2003 Gulledge ..... 182/153
6,736,371 B1 * 5/2004 Burrows ..... 254/133 A

* cited by examiner

*Primary Examiner*—Jeanette Chapman
(74) *Attorney, Agent, or Firm*—J. Anderton; Patent Forge

(57) ABSTRACT

A hinged spreader board of a pre-set length with shaped ends is pivoted open inside a frame to mate with the inside faces of the sides of a frame and maintain the sides apart by the length of the board while attaching the frame to a wall. Additional hinged sections of pre-set lengths allow the spreader board to be opened to various lengths to accommodate frames of different widths. The frame spreader boards fold up for storage.

16 Claims, 4 Drawing Sheets

HINGED FRAME SPREADER

BACKGROUND OF THE INVENTION

1. Field of the Invention

The present invention relates to door frame alignment devices and particularly to a hinged and foldable spreader for door jambs and other frame structures with ends that conform to the profile of the inner surface of the frame, which spreader may be placed between the frame legs in an angled position and pressed downwardly into an extended straight position to set said legs to a predetermined distance from one another.

2. Description of the Prior Art

Building construction involves precise measurements and calculations in order for a structure to be properly built. One mistake or miscalculation can be magnified many times over and can, result in the redoing and recalculation of substandard work. No construction feature requires more precision and accuracy than setting door jambs.

Prior art devices are often overly complex or expensive and not always sufficiently sturdy to withstand repeated usage over time. Most are a set length for only one size frame.

U.S. Pat. No. 824,777, issued Jul. 3, 1906 to Brooks, shows a support for fitting doors that comprises two main horizontal arms hinged together and adapted to lock in horizontal position. A slidably adjustable and rigidly securable arm is provided on one of the hinged arms, which extends beyond the hinged arm. A door holding bracket is provided on the non-slidable hinged arm. Sockets are provided on the outer ends of the door holding arm and the slidable arm. Rubber pads are secured in the sockets and extend therefrom.

U.S. Patent Application #20020170189, published Nov. 21, 2002 by Cheatham, describes an apparatus used to align door jambs and like structures. A base member comprises a substantially longitudinal section through which a channel is formed in the top surface thereof, one end extending into a first jamb spreader. A first extension member is slidably coupled within the channel of the base member, the extended end of the extension member depending into a second jamb spreader. A second extension member is slidably coupled within the channel of the base member opposite the first extension member, the end opposing the second jamb spreader depending into a third jamb spreader. The jamb spreader of the first and second extension members include horizontal and vertical leveling members. By positioning the opposed jamb spreaders against the opposed door jambs or surfaces, the alignment of the door jambs and door frame may be determined to be in square and plumb alignment.

U.S. Pat. No. 3,851,868, issued Dec. 3, 1974 to Lagasse, provides an adjustable self-supporting door buck spreader, which is adapted for use in the installation of door frames of different sizes, and particularly for door frames which are made of metal. The door buck spreader comprises a pair of overlapping elongated members each having buck engaging means provided at one end thereof, measuring means for indicating the distance between the buck engaging means, first adjustment means for adjusting the distance between the buck engaging means, and second adjustment means for adjusting the buck engaging means for use with door bucks having different sized ribs. Each of the buck engaging means includes magnetic means operable for magnetically holding the door buck spreader in engagement with the bucks of a metal door frame thereby to enable the buck spreader to be self-supporting. To employ the door buck spreader, the pair of elongated members are extended until the measuring means indicates that the distance between the door buck engaging means corresponds to the width desired for the door openings. The door buck spreader is then positioned between the bucks of the door frame so that the buck engaging means of the spreader are in engagement therewith. Thereafter, with the door buck spreader operating to maintain the door bucks spaced apart the desired distance, the door frame is anchored to the floor or other suitable supporting surface.

U.S. Pat. No. 5,775,036, issued Jul. 7, 1998 to Stanley, Sr., discloses an apparatus that allows for the alignment of objects with respect to one another, which has a base element having an upper extendable member positioned upon and movable relative to the base. Recesses are provided on either end of the base and extendable member, which allow for the apparatus to hold objects in alignment with respect to one another. The apparatus may be used to align door jambs and window frames when installing portals within a wall structure. Fasteners may be loosened to allow for relative movement between the base and extendable member. When the proper length is attained the fasteners are tightened allowing the apparatus to hold the aligned objects until the objects are set in place within the final construction.

U.S. Pat. No. 1,336,426, issued Apr. 13, 1920 to Frederickson, indicates a gage used for spacing and holding the parts of a door frame or similar structure while the same are being placed in position. The gage comprises a spacing member and a transverse bar disposed at each end of the member, each of the bars being adapted to engage one side of a door frame. The gage also comprises a fixed clamp jaw at one end of each of the transverse bars and a movable clamp jaw on the other end of each said transverse bars, said movable clamp jaws being slidable toward and away from the fixed clamp jaw. The clamp jaws of each transverse bar are adapted to engage the opposite edges of the adjacent door frame side. The gage further comprises means for securing the movable clamp jaws to their respective transverse bars, whereby to rigidly clamp the latter to the door frame sides.

U.S. Pat. No. 4,829,727, issued May 16, 1989 to Kuzara, Jr., puts forth a method and apparatus for preparing a frame for installation in a door opening. An apparatus and method are provided for squaring and decambering at the assembly plant, and shimming at the job site, a thin metal door frame wherein the frame becomes an integral part of its own setting jig until installation, after which the semi-permanent setting jig is removed. Temporary jigs are used in the method to set the minimum door width tolerance and to square the frame elements.

U.S. Pat. No. 5,340,095, issued Aug. 23, 1994 to Eicher, III, describes a door buck spreader that had the capability to support and transport a door buck, or door frame, from its time of construction to its time of final installation. This spreader is a self-contained unit that does not require any additional support members or apparatus. The spreader is capable of setting standard size door and window bucks to bucks as large as eight feet across. The present invention is capable of precise adjustment due to the intel action between a threaded core member and two elongated tubular elements that each engage the core in one end and are rigidly attached to frame mounts at the other ends thereof. The present invention is further capable of adapting to most any door buck by means of longitudinally and laterally displaceable spacer elements and securing such door bucks to the spreader itself by means of a frame clamp assembly.

U.S. Pat. No. 6,152,424, issued Nov. 28, 2000 to Lapat, claims a door and window frame spreader, which comprises a screw device for imposing spreading forces on opposing surfaces, having a pin adjustable length and employing a rod member having a groove in the end for engaging the pin.

U.S. Pat. No. D310,159, issued Aug. 28, 1990 to Priola, shows the ornamental design for a jack-type door jamb spreader.

U.S. Pat. No. 6,530,186, issued Mar. 11, 2003 to Torstensen, concerns a door framing apparatus and method of use. A method and apparatus are provided for installing and trimming a plurality of wooden mounting blocks within a roughed out door frame to prepare the roughed out door frame to receive a finished door frame. The apparatus includes a pair of vertical standard units connected together by a pair of horizontally adjustable spreader units that are adapted to cooperate with one another to conform to the outside dimensions of the finished door frame. Each of the vertical standard units is provided with a plurality of router templates and means for plumbing each vertical standard unit relative to one of the vertical studs in the roughed out door frame; such that the wooden mounting blocks can be glued to the vertical studs and then trimmed using the router templates so that the trimmed mounting blocks are perfectly aligned to receive the finished door frame.

U.S. Pat. No. 3,027,686, issued Apr. 3, 1962 to Oates, illustrates a door frame setting and holding means for placing and securely holding a door frame in an intended set position, which comprises a readily applicable and removable jig. The jig embodies a first T-shaped member comprising an elongated plate providing cross-head, said plate having spaced lengthwise slots, and an elongated leg fixed at an outer end to a median portion of an inward said of said plate and disposed at a right angle to the plate. The jig also comprises a second T-shaped member of the same construction as the first T-shaped member. The legs of the T-shaped members are overlapped and separably and adjustable joined together. The jig further comprises a clamp on the outward side each of the cross-heads for holding the upright members of a door. End brackets are attached to the cross-heads that straddle the outer surfaces of the wall, which have nail openings therethrough for temporarily nailed the brackets to wall surfaces that they bear against.

U.S. Pat. No. 827,284, issued Jul. 31, 1906 to Andersson, is for a threshold gage that comprises a two-membered gage body; the outer ends each member of the gage-body notched to form obtuse angles. The threshold gage also comprises a chamber in each end of the gage body, jamb-face and rabbet gages connected with the gage body and partly contained in said chambers and adapted to independent, longitudinal, and pivotal adjustment with relation to the gage body. Springs contained in the chambers bear against the inner ends of each of the said gages and exert a constant longitudinal pressure thereon, and also a pivotal pressure upon any gage that may be forced up against a surface which is slanting or disposed laterally other than at right angles to the threshold. Collars for holding the gage body, thumb-screws for holding the gages at the desired adjustment, and stops carried by the gage body are provided.

U.S. Pat. No. 3,168,305, issued Feb. 2, 1965 to Lee, provides a doorjamb setter comprising a pair of laterally spaced uprights, means on the uprights for holding the uprights in line with door side jambs, an adjustable gage bar that extends between and connects to the uprights, and side jam clamps on the uprights that comprise channel brackets fixed on the uprights, and L-shaped members having foot portions overlapped and slidably confined in the channel brackets. The foot portions have registered longitudinal slots. The doorjamb setter further comprises clamping screws extending through the slots and threaded into the channel brackets.

What is needed is a sturdy, easy-to-use, inexpensive spreader which quickly sets up inside the frame to spread the frame the exact distance desired.

SUMMARY OF THE INVENTION

An object of the present invention is to provide a hinged spreader board of a pre-set length for conventional frame widths to provide the exact spreader distance between the sides of the frame, the spreader board having ends conforming to the inside profile of the sides of the frame so that the spreader board can be positioned between the sides of the frame with the spreader angled and then the spreader board can be straightened out to contact the sides of the frame and hold them the exact distance apart thereby providing a sturdy, easy-to-use, inexpensive frame spreader which quickly sets up inside the frame to spread the frame the exact distance desired.

Another object of the present invention is to provide additional add-on sections, each of a pre-set length, hinged to the ends of the spreader board, which add-on sections can be unfolded into a straight position extending from the end in linear alignment with the spreader board for a longer spreader board or folded over onto the spreader board for a shorter spreader board to fit a variety of different conventional frame widths.

A related object of the present invention is to provide the ends of the add-on sections with a shape which conforms to the inner profile of the sides of the frame to insure a precision fit for an exact spreader distance.

An additional object of the present invention is to provide elevating members on the bottom of the spreader board to accommodate the thickness of the hinges and maintain the boards in alignment in both the straight position for use and the folded up position for storage.

A further object of the present invention is to provide a spreader board with a single narrow add-on section having a center recess in the outer edge for a frame door stop to match the center recess at the other end of the spreader board, so that the spreader board may be used with frames having door stops which are wider than the recess by pivoting the add-on section over the board and contacting the outer surfaces of the ends with the door stops rather than having the door stops in the recesses.

In brief, a board is cut in half and hinged in the center and the outer ends of the board are cut into the profile of an inner side frame of a door frame or other type of frame being constructed, the hinged spreader board having a pre-set length equal to a conventional frame width. Additional add-on sections of different pre-set lengths may be hinged to the outer ends for use in lengthening the spreader bar to fit larger conventional frame widths. Elevating members on the bottom of the spreader bar and add-on sections and on the top of the add-on sections accommodate the thickness of the hinges to maintain the boards in linear alignment in the straight position in use and in parallel alignment in the folded up position for storage.

An advantage of the present invention is that it provides a sturdy, easy-to-use, inexpensive spreader which quickly sets up inside the frame to spread the frame the exact distance desired.

Another advantage of the present invention is that it provides add-on sections that can be unfolded into a straight position extending from the end in linear alignment with the spreader board for a longer spreader board or folded over onto the spreader board for a shorter spreader board to fit a variety of different conventional frame sizes.

A related advantage of the present invention is to provide the ends of the add-on sections with a shape which conforms to the inner profile of the sides of the frame to insure a precision fit for an exact spreader distance.

An additional advantage of the present invention is that it provides feet on the bottom of the spreader bar for ease of use in handling the spreader bar by keeping it up off the floor surface or threshold and to avoid any uneven floor surfaces which might throw the horizontal spreader distance off.

Yet one more advantage of the present invention is that a spreader bar with at least one narrow add-on section may be used alternately with a narrow door stop in each center recess at the ends or with a wider door stop and the add-on section pivoted over the board having the outer face of each end contacting the wider door stops.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 13:
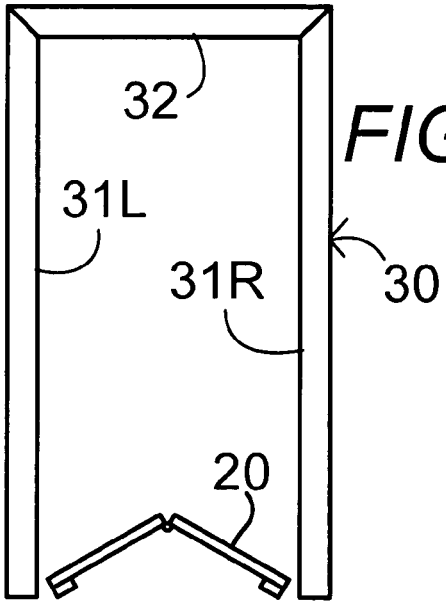
FIG. 13 is a front elevational view of a door frame showing the hinged frame spreader of FIG. 1 angled partially open between the sides of the door frame in preparation for fully extending the hinged frame spreader.
Figure 14:
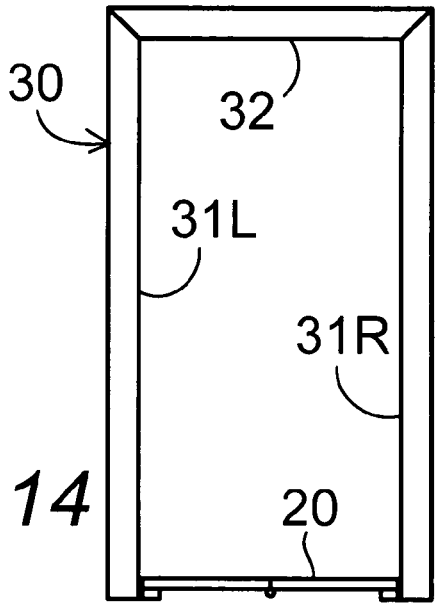
FIG. 14 is a front elevational view of a door frame showing the hinged frame spreader of FIG. 1 fully extended in a straight open position between the sides of the door frame contacting both sides of the door frame.
Figure 15:
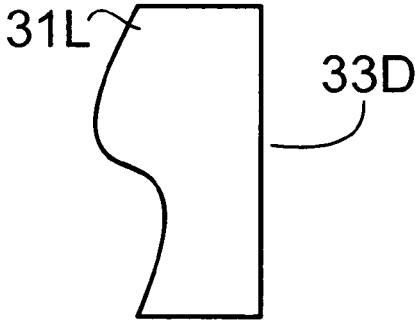
FIG. 15 is a partial top plan view of one side of a cased opening no door frame showing an inside profile with a straight edge.
Figure 16:
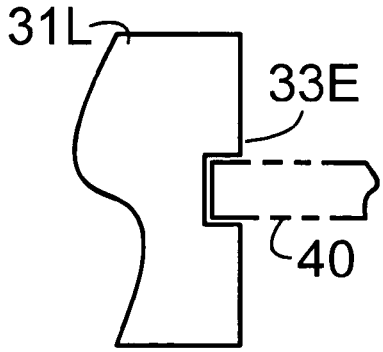
FIG. 16 is a partial top plan view of one side of a window frame showing an inside profile with a center recess to receive the glass.

In FIGS. 1-19, a hinged frame spreader device 20, 20A and 20C is adapted with a pre-set length for maintaining a pair of frame sides 31L and 31R spaced apart a desired distance during installation of a frame structure 30, such as a door frame or window frame or any other type of frame in a wall, as seen in FIG. 14.

Figure 1:
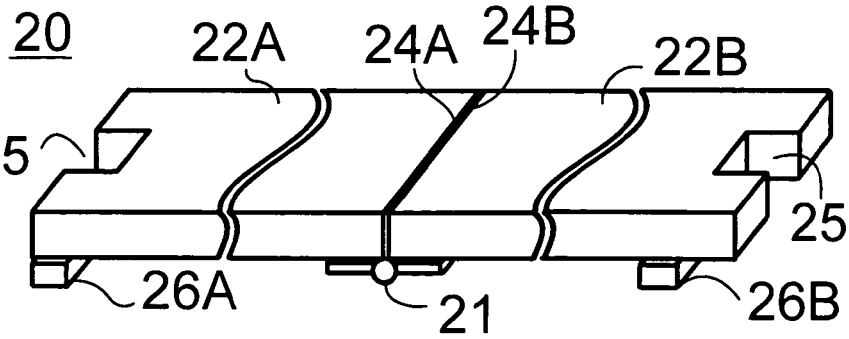
FIG. 1 is a perspective view of the hinged frame spreader of the present invention having a pair of boards hinged together with center cutout end profiles to match the inner side profiles of the frame with the spreader in the fully extended straight position.
Figure 2:
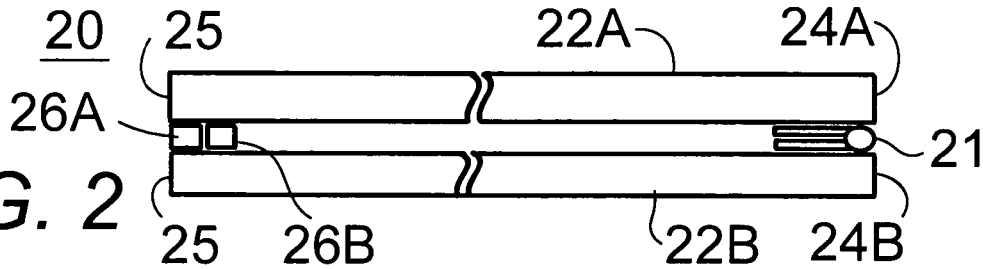
FIG. 2 is a side elevational view of the hinged frame spreader of FIG. 1 in the folded position for storage.
Figure 7:
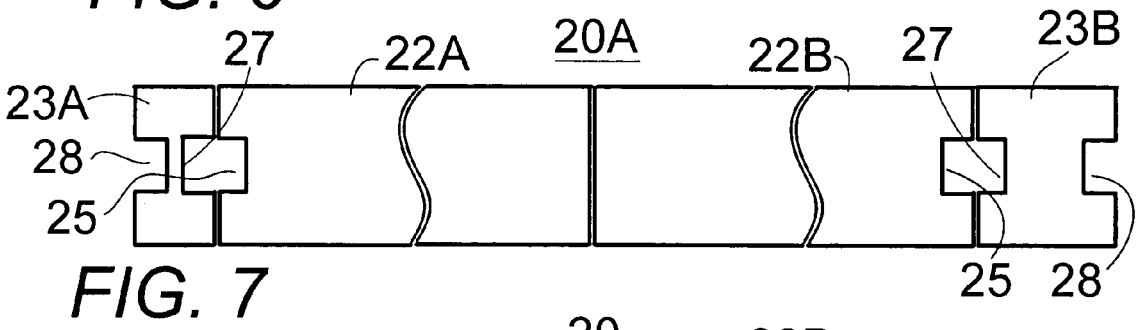
FIG. 7 is a top plan view of the preferred embodiment of the hinged frame spreader of FIG. 3 showing the center cutout end profiles on both the center hinged portions and the add-on sections to match the inner side frame profiles of differently sized frames.
Figure 8:
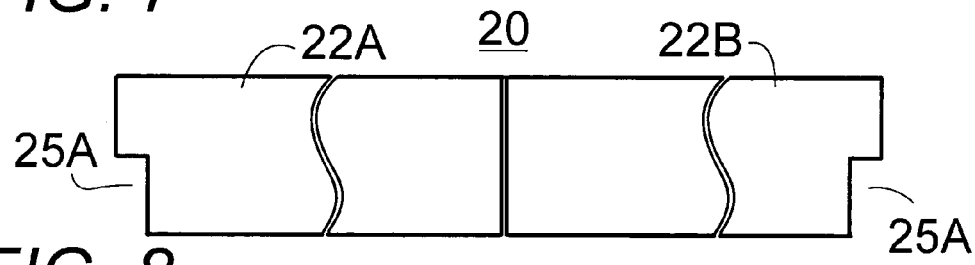
FIG. 8 is a top plan view of a hinged frame spreader of FIG. 1 showing alternately shaped end profiles with a single stepped profile to match the inner side frame profiles of a different frame.
Figure 9:
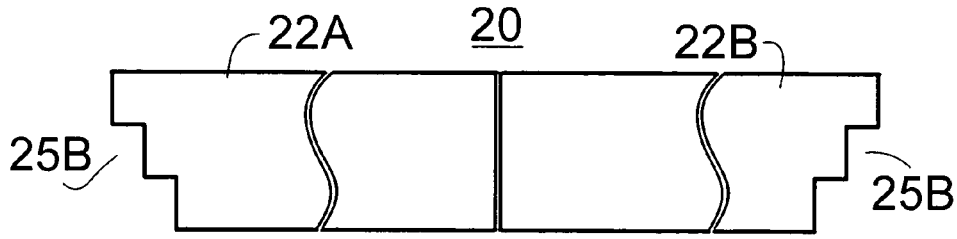
FIG. 9 is a top plan view of a hinged frame spreader of FIG. 1 showing alternately shaped end profiles with a double stepped profile to match the inner side frame profiles of a different frame.
Figure 10:
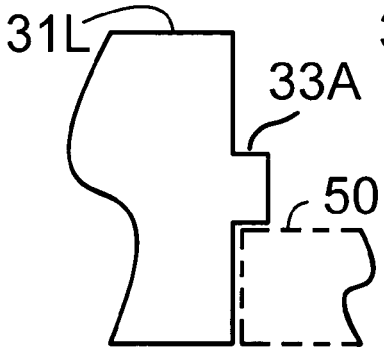
FIG. 10 is a partial top plan view of one side of a standard door frame showing an inside profile with a single center protrusion door stop.
Figure 11:
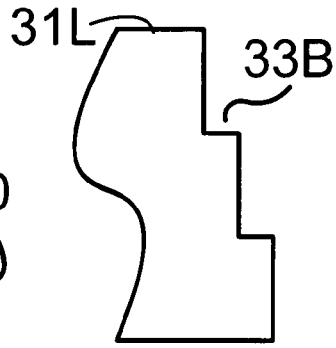
FIG. 11 is a partial top plan view of one side of a double egress door frame showing an inside profile with a double step.
Figure 12:
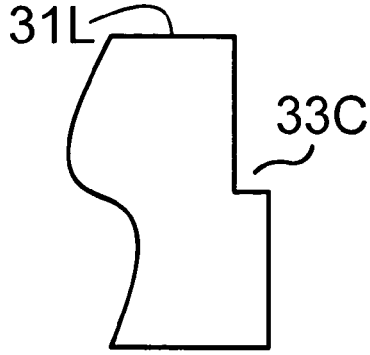
FIG. 12 is a partial top plan view of one side of a single egress door frame showing an inside profile with a single step.

In FIGS. 1, 2, 6, 8, 9, 13 and 14, the frame spreader device comprises a first elongated board 22A and a second elongated board 22B hinged together in longitudinal linear alignment by a pivotable hinge 21 connecting two inner edges 24A and 24B of the boards to form a hinged frame spreader board 20 of a pre-set length based on conventional frame widths. Each of the boards has an outer edge 25, 25A, and 25B shape to conform to an inside profile 33A-33E of a side of a frame member 31L and 31R, aligned for installation to a wall structure. Various different frames with different profiles, such as 33A-33E shown in FIGS. 10-12, 15 and 16, require different outer edge configurations 25, 25A and 25B. The outer edge configuration 25 with a central recess, as seen in FIGS. 1, 5, 6, and 7, mates with a regular doorway frame profile 33A with a central protruding door stop of FIG. 10 (showing door 50), a cased opening frame profile 33D with no door of FIG. 15, and a window frame profile 33E of FIG. 16 (showing window pane 40). A single step outer edge configuration 25A, as seen in FIG. 8, mates with a single egress door frame profile 33C of FIG. 12. A double step outer edge configuration 25B, as seen in FIG. 9, mates with a double egress door frame profile 33B of FIG. 11. The hinged frame spreader board 20 is sized in a pre-set length to provide a desired standard distance between a pair of sides 31L and 31R of a frame 30 equal to the length of the hinged frame spreader board 20, as shown in FIG. 14, which forms an upright rectangular frame with the top of the frame 32 and the two sides 31L and 31R. In FIG. 13, to install the hinged frame spreader board 20 is pivoted into an angled configuration to position the hinged frame spreader board between a pair of sides 31L and 31R of a frame 30. In FIG. 14, the hinged frame spreader board 20 is pivoted into a straight linear configuration to contact a pair of sides 31L and 31R of a frame 30 and maintain a pair of sides of a frame spaced apart by the length of the hinged frame spreader board while installing a frame in a wall structure. The hinged frame spreader board 20 is pivotable into a folded up position for storage, as shown in FIG. 2.

Figure 3:
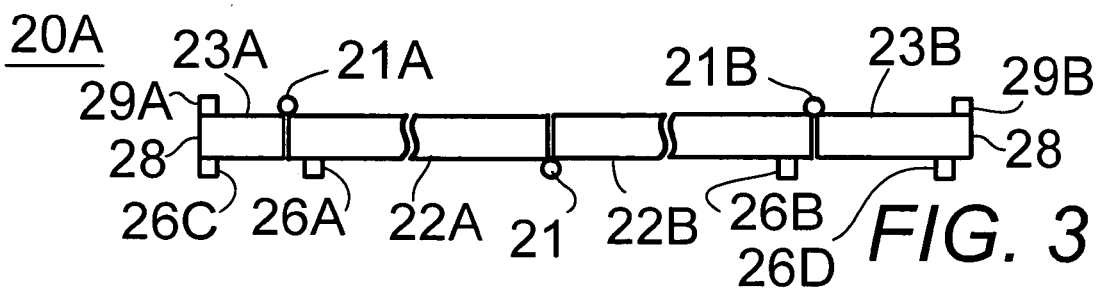
FIG. 3 is a side elevational view of the preferred embodiment of the hinged frame spreader having additional hinged add-on sections on the outer ends to adjust for different sizes of frames with the spreader shown in the fully extended straight position for maximum length.
Figure 4:
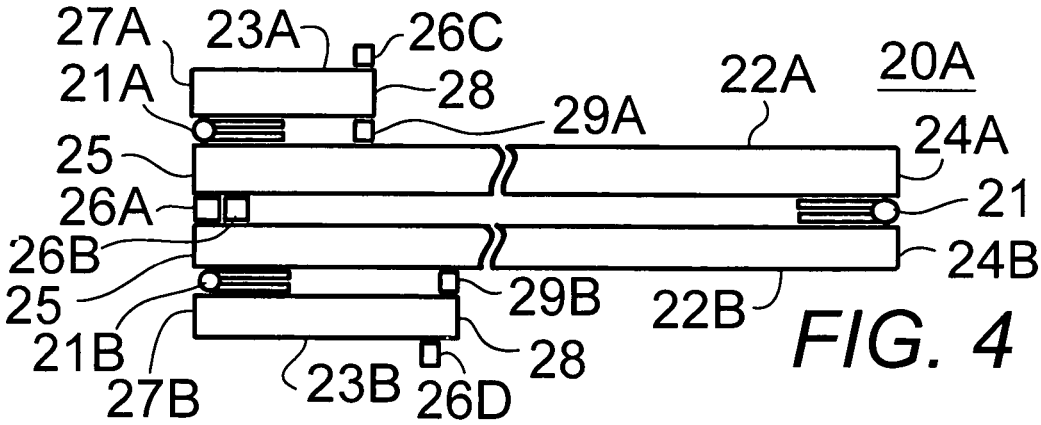
FIG. 4 is a side elevational view of the preferred embodiment of the hinged frame spreader of FIG. 3 with the spreader in the completely folded up position for storage.
Figure 5:
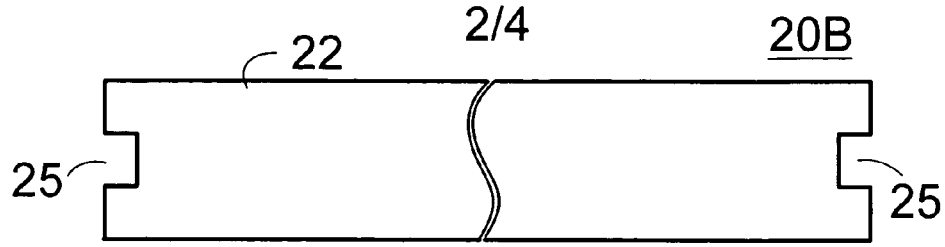
FIG. 5 is a top plan view of a single piece frame spreader with no hinge showing the end profiles to match the inner side frame profiles.
Figure 6:
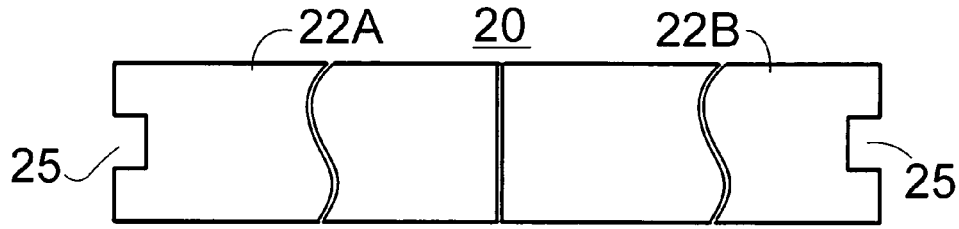
FIG. 6 is a top plan view of the hinged frame spreader of FIG. 1.

In FIGS. 3, 4, 7, and 17-19, the hinged frame spreader board 20A and 20C further comprises at least one, and preferably two, additional pre-set length add-on sections 23A, 23B, and 23C hinged by a pivotable hinge 21A and 21B to the ends 25 of the hinged frame spreader board 20A. Each of the add-on section 23A and 23B is adapted for being unfolded into a straight position aligned with the straightened position of the hinged frame spreader board 20A extending from the end in linear alignment with the hinged frame spreader board 20A to form a longer hinged frame spreader board, as shown in FIGS. 3 and 7 and adapted for being pivoted into a folded over position onto the spreader board for a shorter hinged frame spreader board to fit between a variety of standard spaced frame sides. The center hinged board 22A and 22B could have a length equal to a standard frame length, such as 30" to be used with a 30" frame width with the add-on sections 23A and 23B folded up. If add-on section 23A were 2" in length and add-on section 23B were 4" in length, folding out only add-on section 23A the hinged frame spreader device 20A would fit a 32" wide frame, folding out only add-on section 23B, the hinged frame spreader device 20A would fit a 34" wide frame, and folding out both add-on sections 23A and 23B, the hinged frame spreader device 20A would fit a 36" wide frame. The entire hinged frame spreader board 20A is adapted to be pivoted into a folded up position for storage, is shown in FIG. 4.

Each of the add-on sections 23A and 23B has an outer edge shape 28, as shown in FIG. 7, to conform to an inside profile of a side of a frame member aligned for installation to a wall structure to insure a precision fit for an exact spreader distance and each of the add-on sections 23A and 23B has in inner edge shape 27, as shown in FIG. 7, to conform to the outer edge shape 25, (also 25A and 25B) of the hinged frame spreader board 20A in the folded over position so that the outer edge shape 25 of the main board fits with the inside profile of the side 31L and 31R of a frame 30 with the add-on section 23A and 23B in the folded up position, enabling the board to be used for frames of various widths.

Figure 17:
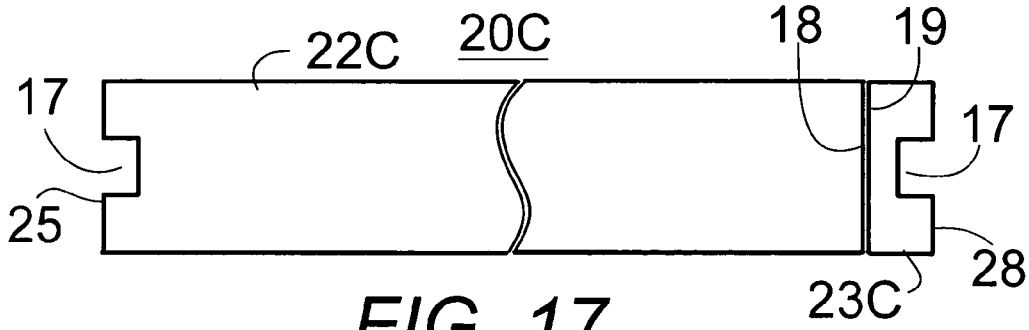
FIG. 17 is a top plan view of an alternate embodiment of the hinged frame spreader of FIG. 3 showing a single piece frame spreader board with one narrow add-on section hinged to one end, the unhinged end of the board having a center recess in the face to receive a door stop on a side of a frame and the add-on section having a similar center recess, the narrow add-on section adapted to fold over exposing a smooth end of the board for using the board with wider door stops on the sides of frames.
Figure 18:
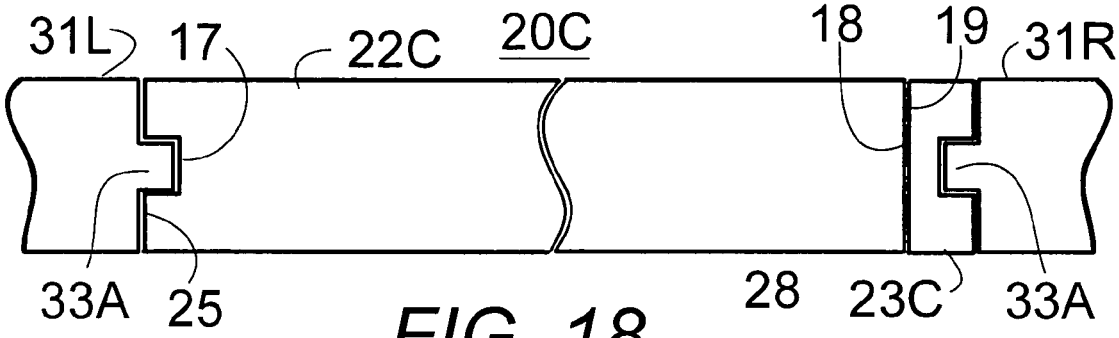
FIG. 18 is a top plan view of the alternate embodiment of the hinged frame spreader of FIG. 17 in place between the sides of a frame with the door stops of the frame fitting within the recesses at the ends of the board.
Figure 19:
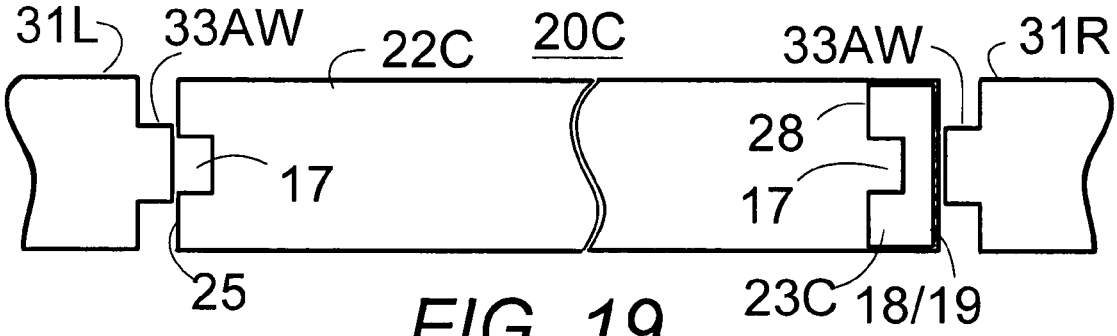
FIG. 19 is a top plan view of the alternate embodiment of the hinged frame spreader of FIG. 17 in place between the sides of a frame with wide door stops of the frame not fitting within the recesses at the ends of the board, and the add-on section pivoted back onto the board so that the wide door stops contact the outer edge of the board on one end and the straight hinge surface on the other end of the board.

In FIGS. 17-19, the hinged frame spreader 20C comprises a single elongated spreader board 22C with one short add-on section 23C hinged to one end. The unhinged end of the board has a center recess 17 in the end face 25 and the end face 28 of the add-on section 23C has a similar center recess 17 to receive a door stop 33A within the center recess 17 at each end, as seen in FIG. 18. The elongated spreader board 22C has a smooth inner edge 18 and the short add-on board 23C has a mating smooth inner edge 18, the two boards interconnecting along the smooth edges by a hinged connection.

Each of the outer edges of the two boards comprises an end face 25 and 28 having a recessed center opening 17 adapted for receiving a door stop 31A therein, as seen in FIG. 18. The elongated spreader board 22C is equal in length to a distance between a pair of inner faces of a pair of door stops 31A on a pair of sides of a frame 31L and 31R and the short add-on board 23C is equal in length to a double thickness of a door stop 31A, so that the frame spreader device is adapted for alternately being positioned in a first position, as seen in FIG. 18, with the add-on section 23C in linear alignment with the elengated board 22C with a door stop 31A fitting within each of the recessed center openings 17 and in a second position, as seen in FIG. 19, with the add-on section 23C pivoted on top of the elongated board 22C with the end faces 18 and 19 contacting the inner faces of the pair of door stops 31AW for a pair of wider door stops 31AW are wider than the recessed center openings 17 and which do not fit in the recessed center openings 17.

In FIGS. 1-4, the hinged frame spreader device 20 and 20A further comprises at least one elevating member 26A-D on each of the boards adapted for elevating the frame spreader device up off a lower surface below a frame to accommodate the thickness of the hinge 21, 21A, and 21B in both the straight elongated position, as shown in FIGS. 1, 3, and 14 and in the folded up position, as shown in FIGS. 2 and 4. The add-on sections 23A and 23B have additional spacers 29A and 29B to accommodate the thickness of the hinges 21A and 21B in the folded up position, as shown in FIG. 4.

The hinged frame spreader board may be fabricated of any rigid material including wood, metal, and plastic, preferably acrylic formed from acrylic sheets.

It is understood that the preceding description is given merely by way of illustration and not in limitation of the invention and that various modifications may be made thereto without departing from the spirit of the invention as claimed.

What is claimed is:

1. A frame spreader system with extended and retracted positions for a spreader and at least one preset spreader length that spaces frame components in a wall at a preset distance, the spreader system comprising:

at least one vertical frame member including a door stop and two recessed parallel surfaces separated by the door stop at least one elongate body member;

a first extension hingeably attached to the at least one elongate body member and configured to move between a folded position and an unfolded position, the extension including an end portion configured to receive the door stop and contact at least one recessed parallel surface wherein in the folded position the first extension overlaps the at least one elongate body member and does not contribute to the spreader length; and in the unfolded position the first extension extends from the at least one elongate body member and contributes to the spreader length; and wherein in the extended spreader position the frame components contact two end portions of the spreader at the preset spacing distance, and in the retracted spreader position the two end portions of the spreader are spaced from the frame components.

2. The frame spreader of claim 1 further comprising a second extension hingeably attached to the at least one elongate body member and configured to move between a folded position and an unfolded position where:

in the folded position overlapping the at least one elongate body member the second extension does not contribute to the spreader length; and in the unfolded position extending from the at least one elongate body member the second extension contributes to the spreader length.

3. The frame spreader of claim 2 wherein at least one end portion of the first extension, at least one end portion of the elongate body member and at least one end portion of the second extension conforms, at least in part, to the door stop of the frame component for which the spacing is set by the spreader.

4. The frame spreader of claim 1 further comprising standoffs to elevate the spreader above floor level.

5. A frame alignment system comprising:

a frame to be positioned in a wall opening, the frame including two spaced apart, vertical frame components, at least one of the vertical frame components including a door stop and two recessed parallel surfaces separated by the door stop; and a spreader with extended and retracted positions that define at least one spreader distance for the two vertical frame components, the spreader including:

a plurality of members, the summed lengths of unfolded members defining the at least one spreader distance including at least two member end portions configured in an extended spreader position to contact the vertical frame components, and at least one of the at least two member end portions is configured to receive the door stop and contact the two recessed parallel surfaces of the vertical frame component, and the member end portions in a retracted spreader position are spaced from the vertical frame components; and at least one hinge to pivotally join each member to at least one other member.

6. The framing system of claim 5 wherein the spreader includes two members joined by a hinge and the sum of the unfolded member lengths define at least one spreader distance for the vertical frame components.

7. The framing system of claim 5 wherein the spreader includes first, second and third members and the sum of the unfolded member lengths define at least two spreader distances for the vertical frame components.

8. The framing system of claim 7 wherein the third member moves between:

an unfolded position, in which the summed lengths of all three unfolded members defines a first spreader distance; and a folded position with the third member overlapping the first member, in which the summed lengths of the first and second members in the unfolded position define a second spreader distance.

9. The framing system of claim 7 wherein the spreader includes three member end portions, each configured to receive a door stop of the vertical frame components.

10. The framing system of claim 5 wherein the spreader includes four members where summed lengths of unfolded members define at least three spreader distances for the vertical components.

11. The framing system of claim 10 wherein the third member moves between an unfolded position extending from the first member and a folded position overlapping the first member, and the fourth member moves between an unfolded position extending from the second member and a folded position overlapping the second member, and with the first and second members in an unfolded position:

with the third and fourth members in folded positions and overlapping the first and second members, the summed lengths of first and second members define a first spreader distance;

with the third member unfolded and the fourth member folded and overlapping the second member, the summed lengths of first, second and third members define a second spreader distance; and with the third member folded and overlapping the first member and the fourth member unfolded, the summed lengths of first, second and fourth members define a third spreader distance.

12. The framing system of claim 5 the spreader further including standoffs to elevate the spreader above floor level.

13. A method for aligning a frame in a wall opening with a spreader that moves between extended and retracted positions, the method comprising:

positioning a hinged retracted spreader, including first and second members and first and second member ends, between first and second vertical members of the frame where the first and second member end portions are spaced from the first and second vertical members;

extending the hinged spreader by unfolding at least one member, the combined length of unfolded members defining at least one spreader distance for the frame;

moving the first vertical frame member to contact the first member end portion where the first vertical frame member includes a door stop and two parallel faces separated by the door stop and the first member end portion is configured to receive the vertical frame member door stop and contact the first vertical member parallel faces separated by the door stop; and moving the second vertical frame member to contact the second member end portion.

14. The frame aligning method of claim 13 where the first member includes the first end portion and the second member includes the second end portion.

15. The frame aligning method of claim 13 wherein the spreader further includes a third hinged member and unfolding the hinged spreader includes, with the third hinged member in a folded position overlapping the first member, in which the combined length of first and second unfolded members define a first spreader distance, moving the third member to an unfolded position in which the combined length of the first, second and third unfolded members define a second spreader distance.

16. The frame aligning method of claim 13 wherein the spreader further includes third and fourth hinged members and unfolding the hinged spreader includes:

with the first and second hinged members in an unfolded position and with the third and fourth hinged members in a folded position overlapping the first and second members, in which the combined first and second member lengths define a first spreader distance, moving the third hinged member from the folded position overlapping the first member to an unfolded position in which the combined first, second and third member lengths define a second spreader distance; and with the first, second and third hinged members in the unfolded position, moving the fourth hinged member from the folded position overlapping the second member to an unfolded position in which the combined first, second, third and fourth member lengths define a third spreader distance.

* * * * *